United States Patent [19]

Ishizuka

[11] Patent Number: 4,565,354

[45] Date of Patent: Jan. 21, 1986

[54] APPARATUS FOR PRODUCING PURIFIED REFRACTORY METAL FROM A CHLORIDE THEREOF

[76] Inventor: Hiroshi Ishizuka, 19-2, Ebara 6-chome, Shinagawa-ku, Tokyo, Japan

[21] Appl. No.: 496,939

[22] Filed: May 18, 1983

[30] Foreign Application Priority Data

May 31, 1982 [JP] Japan ..... 57-93698
Oct. 28, 1982 [JP] Japan ..... 57-189846

[51] Int. Cl.[4] ..... C22B 4/08
[52] U.S. Cl. ..... 266/171; 266/905
[58] Field of Search ..... 266/905, 168, 171, 149; 75/84.5, 84.4

[56] References Cited

U.S. PATENT DOCUMENTS

| | | | |
|---|---|---|---|
| 2,756,043 | 7/1956 | Fleiszar, Sr. et al. | 266/905 |
| 3,684,264 | 8/1972 | Petrov et al. | 266/905 |
| 3,715,205 | 2/1973 | Ishizaka | 266/905 |
| 4,441,925 | 4/1984 | Ishizuka | 266/168 |
| 4,447,045 | 5/1984 | Kimura et al. | 266/905 |

*Primary Examiner*—L. Dewayne Rutledge
*Assistant Examiner*—S. Kastler
*Attorney, Agent, or Firm*—Larson and Taylor

[57] ABSTRACT

An apparatus and a method for producing purified refractory metal from a chloride thereof, comprising: a conversion/evaporation chamber, defined by a first substantially cylindrical vessel means and a first detachable top thereover, said top comprising therewithin an axially extending cell with an opening at a bottom thereof, a cavity with a flanged outlet to serve as a path for effluent vapor, further, a gas jacket and a water jacket arranged close to said cell and cavity for temperature control, and a valve arranged in the cavity for regulation of vapor flow, a tube so arranged as to movable vertically and to extend along the axis of the top for feeding the chloride to magnesium as fused and held in said chamber, a closure arranged around and movable together with said tube for regulating the opening of the cell, a furnace means which surrounds to heat said chamber, a condensation chamber, defined by a second substantially cylindrical vessel means and a second detachable top thereover, said top having a cavity to serve as a path for incoming vapor, and a degassing means connected thereto, a cooling means for the condensation chamber by passing water therealong, a heatable duct in flanged connection with the outlet of the cavity over the conversion/evaporation chamber and extending to the cavity over the condensation chamber so as to provide a continuous passage for vapor from the former to latter chambers, said first and second vessel means further comprising, each, a cylindrical member of a substantially common geometry such as to support metallic product and to allow joint thereof to respective tops with a fastening means compatible with each other.

13 Claims, 8 Drawing Figures

APPARATUS FOR PRODUCING PURIFIED REFRACTORY METAL FROM A CHLORIDE THEREOF

Figure 1:
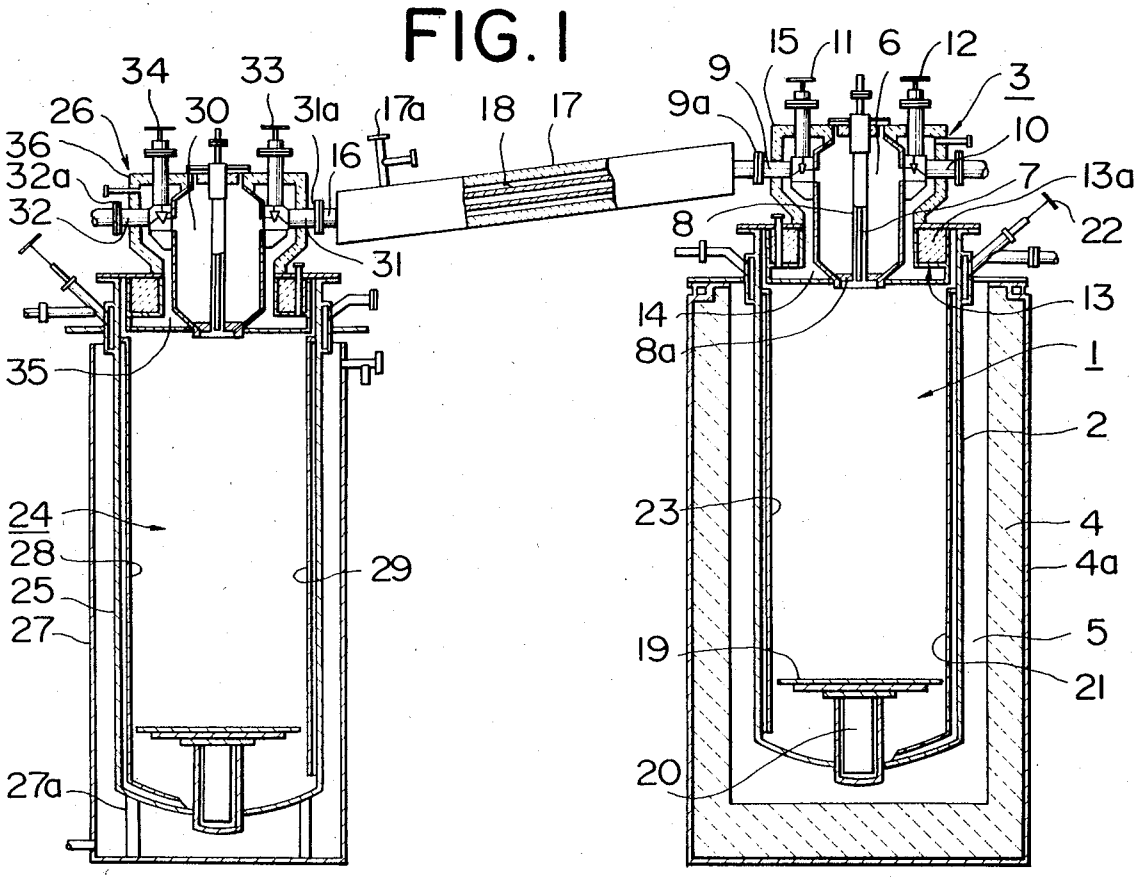

The present invention relates to improvements in production of purified refractory metal such as titanium, zirconium, hafnium, niobium, and tantalum from a tetra- or pentachloride of corresponding metal. The invention in particular relates to an improved apparatus and a method specifically adapted thereto, which permit an efficient removal of such impurities as magnesium metal and magnesium chloride ($MgCl_2$) from a deposit of refractory metal produced by a so-called Kroll process.

The refractory metals such as said above are commonly produced in industry by this process, wherein their chlorides are reduced with fused magnesium in excess of stoichiometry for minimizing involvement of unfavorable intermediate product of such lower chlorides as $TiCl_2$ or $TiCl_3$. Resulting deposit usually contains, besides the metallic product, impurities of magnesium metal and chloride in abundance, which should be removed subsequently.

Various apparatus constructions have been by now proposed and put in use for practising such reductive conversion and following purification of metal. Some of them are designed to conduct the two stages of process in specialized setups, while the others contemplate them in a single structure. The former group employs apparatuses specially directed to each stage. Although conversion apparatuses of single vessel configuration allow rather a larger batch to be treatable per run, double-cylindrical configurations are preferred mainly for easier handling, such that a cylindrical vessel comprises thereinside a container, or another cylindrical member with a grate at the bottom. Magnesium is fused and held in the vessel, where starting material chloride of refractory metal is supplied and converted to the metal which deposits on the grate. The container, on completion of the conversion, is taken out of the vessel, transferred and set in a distillery retort loaded of a mixed mass of metal with impurities which mainly comprises magnesium metal and chloride. In a vertical alignment over or under the container, a water-cooled condensation vessel is connected which advantageously comprises another cylindrical member of the same geometry as the container. The mass is heated to some 1000° C. in a vacuum in order to purify the metallic product by fusing, evaporating and depositing the magnesium metal and chloride on said member in the condensation vessel. The member can be placed in the conversion apparatus for another process, thus saving otherwise necessary stripping procedure for the condensates.

Such specialization advantageously permits a design of simplicity and improved power efficiency. A substantially increased batch volume is readily available especially by adopting a design where the treatable mass is set under a condensation vessel. The design, however, has a drawback that a substantial cost is inevitable in labor, time and/or power in or for cooling, transfer and re-heating of the mass and assembling and disassembling of both apparatuses.

Single structure constructions, on the other hand, essentially eliminate such disadvantage by permitting both stages to be conducted in an elongated apparatus, where refractory metal is converted from starting material chloride and deposited in the lower section, then heated to evaporate therefrom magnesium metal and chloride which ascend the apparatus and get caught as condensates in the upper section in a coaxial alignment with the lower section, as seen in U.S. Pat. No 3,684,264 to Ivanovich Petrov et al for example. An apparent drawback is that this construction requires rather a sophisticated device which can isolate the sections during the conversion and can be removed for the purification.

Further, common drawback is observed in such vertical arrangement of either single- or double-cylindrical configuration, where treatable mass is placed in the lower section: it is necessary that condensates deposit as solid and adhere to a wall in order to rest in the upper section. This can be done only at a limited rate for, as condensation proceeds, vapor of magnesium metal and chloride can be cooled from outside at a decreasing efficiency through a porous layer of an increasing thickness in a very thin atmosphere. In addition, such condensates are often observed to detach and drop into a mass under treatment in the lower section due to often severe heat radiation from the lower section as heated, which causes partial melting of once depositing condensates.

It is desirable in any case to achieve a sensible improvement in efficiency of purification stage, which conventionally takes a considerable part of overall processing period, since a mixed mass is heated with a furnace from outside to evaporate impurities which leave sponge metal first at the periphery and then increasingly inward positions by heat transmitted through the porous structure over an increasing distance in a very thin atmosphere.

Therefore, one of the principal objects of the invention is to provide an apparatus for producing purified refractory metal from a chloride thereof, which is free of above described drawbacks.

Another objects is to provide a method specifically adapted to such apparatus.

According to the invention there is provided an apparatus which comprises: a conversion/evaporation chamber, defined by a first substantially cylindrical vessel means and a first detachable top thereover, said top comprising therewithin an axially extending cell with an opening at a bottom thereof, a cavity with a flanged outlet to serve as a path for outgoing vapor, further, a gas jacket and a water jacket arranged close to said cell and cavity for temperature control, and a valve arranged in the cavity for regulation of vapor flow, a tube so arranged as to movable vertically and to extend along the axis of the top for feeding the chloride to magnesium as fused and held in said chamber, a closure arranged around and movable together with said tube for regulating the opening of the cell, a furnace means which surrounds the heat said chamber, a condensation chamber, defined by a second substantially cylindrical vessel means and a second detachable top thereover, said top having a cavity to serve as a path for incoming vapor, and a degassing means connected thereto, a cooling means for the condensation chamber by passing water therealong, a heatable duct in flanged connection with the outlet of the cavity over the conversion/evaporation chamber and extending to the cavity over the condensation chamber so as to provide a continuous passage for vapor from the former to latter chambers, said first and second vessel means further comprising, each, a cylindrical member of a substantially common geometry such as to support metallic product and to allow joint thereof to respective tops with a fastening means compatible with each other.

Also provided is a method for producing purified refractory metal from a chloride thereof, comprising: holding fused magnesium in a heatable closed vessel means, supplying chloride of refractory metal to cause a reaction thereof with the magnesium to deposit refractory metal and magnesium chloride, terminating the reaction to leave a mixed mass of said metal with impurities of magnesium metal and magnesium chloride, heating said mass so as to evolve vapor of impurities which ascends the vessel means, communicating said heatable closed vessel means with a coolable closed vessel means in a side-by-side arrangement therewith by means of a heatable passage through upper ends of said both vessel means, degassing thus combined vessel means so as to cause a draft of vapor from the former to latter vessel means along said passage, transferring vapor of said impurities and cooling the same so as to condense and to be received on the coolable vessel means, continuing such transferring and cooling until the mass in the heatable vessel means exhibits a substantially lowered level of said impurities, as indicated by an elevated degree of vacuum in the vessel means, cooling to provide a solidification surface at an upper end of the heatable vessel means around the passage, said surface allowing existing vapor to deposit as solid thereon so that a higher evaporation rate of impurities may be achieved, and recovering product of thus purified refractory metal from the heatable vessel means, while impurities comprising magnesium metal and magnesium chloride are recovered as deposit in the coolable vessel means.

In the invention the cavity within the first top, or the top for the conversion/evaporation chamber, can terminate over the chamber either into or outside the cell which comprises a regulatable opening at the bottom.

The duct extending between the two chambers comprises a heating means which can be, in an instance, an electrical furnace which surrounds and extends along the duct. This arrangement allows an advantage that, with the interspace closed airtightly and provided with a pressure regulating means, the duct can be subjected to milder conditions physically and chemically. The duct alternatively comprises a jacket which can contain either electroresistive heating elements such as nichrome spiral embedded in a layer of electrical insulative mass, or such heated gaseous medium as supplied by a gas burner in operation and passing therethrough.

Such jacketed duct construction, and particularly in cases where the jacket is arranged to extend up to very close to the extremity opposed to the outlet, a water-cooled flange of a decreased outer diameter is available as secured to the outer wall of the jacketed structure for connection with the outlet, without raising risk of plugging or solidification within the duct, while securing that a rubber sealant used between the flanges be kept at temperature levels which may not cause promoted deterioration. Smaller flanges permit installation at locations of decreased dimensions.

The cavity comprises heating means capable to cover all along the path it consists up to the flanged outlet, so that impurities passing therethrough may not solidify to cause plugging. The means can consist of a jacket similar to described above.

The flanges are joined at positions in the vicinity of opposed ends of respective substrates, or the duct and outlet, immediately or by means of some additional parts in several ways. Wholly flat flanges joined directly to the substrates exhibit an optimal strength. It is preferable that at least one of the flanges locates at rather recessed positions backward from opposed extremities and be connected with the partner in such flange arrangements that a small gap is provided, as at room temperatures, between opposed ends of the duct and outlet, so as to allow substantially free expansion of each member as heated. It is also preferable that the duct have a small down-slope such that any liquid condensate depositing in the duct may flow into the condensation chamber.

Each of conversion/evaporation chamber and condensation chamber can conveniently have a top thereover of a common configuration, although better performance is achievable with specialized tops. In the latter case, the duct may be integrally formed with the cavity of the top for the condensation chamber.

The vessel means of the invention, heatable or coolable, consist either single- or double cylindrical configurations. While the former allows to hold both of fused magnesium and depositing metal during a conversion run, the latter comprises, inside a cylindrical vessel, another cylindrical member with a grate at the bottom, as container for the deposit. In each case the conversion/evaporation chamber and condensation chamber comprise common vessel means: when one chamber is double-cylindrical, so is the other, for example. This permits, with a third vessel means of the same construction, a semi-continuous operation by a rotational use of two, while the other is in preparation.

The apparatus and method are especially suitable to production of titanium and zirconium from tetrachloride thereof, although some other refractory metals can be likewise produced.

It is essential that the conversion/evaporation chamber and condensation chamber be arranged in a close side-by-side arrangement and in connection with each other by upper ends thereof, so that evaporated impurities may ascend, flow and enter the condensation chamber from above, so that vapor or liquid condensates formed there or by then may securely rest and may not flow back to evaporation zone.

In preferred practices of the invention, the conversion/evaporation chamber is cooled at the upper end in a conclusive stage of purification process so that remaining vapor of magnesium metal and chloride deposit as solid on a bottom surface of the top.

Other features of the invention and advantages achieved thereby will be better understood from the following description taken in connection with the accompanying drawing which is given by way of example only and not limiting the invention.

Figure 3:
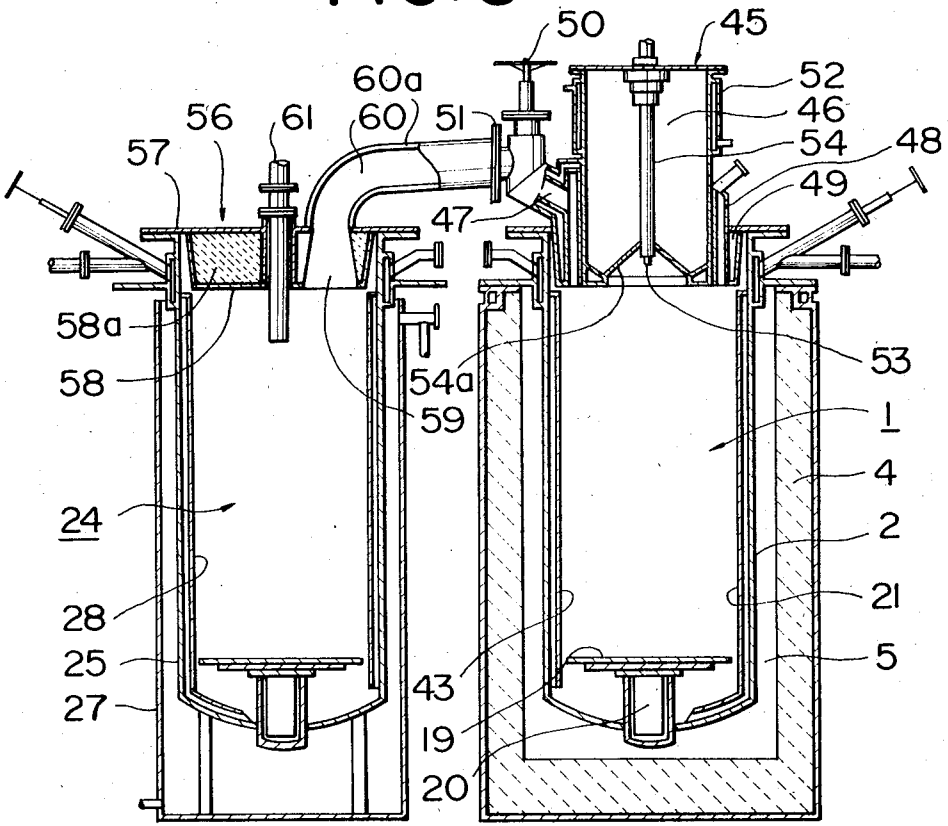
Figure 4:
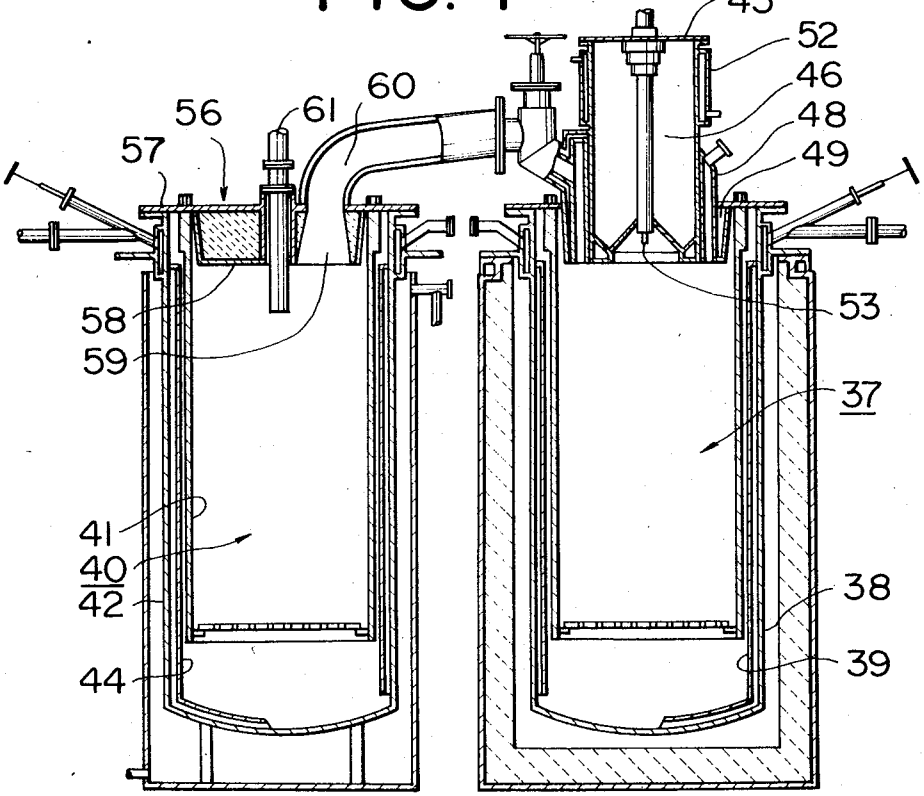
Figure 5A:
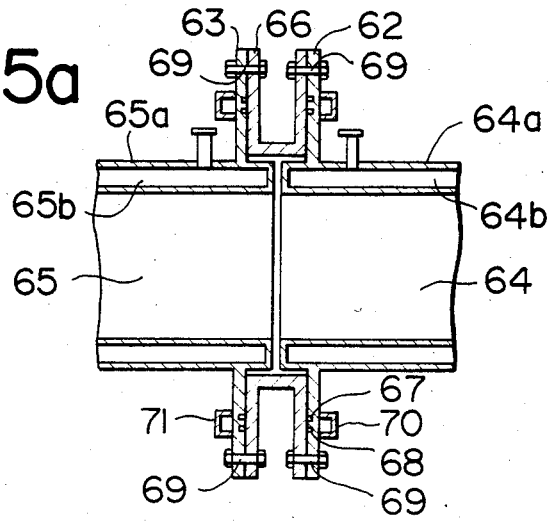
Figure 5B:
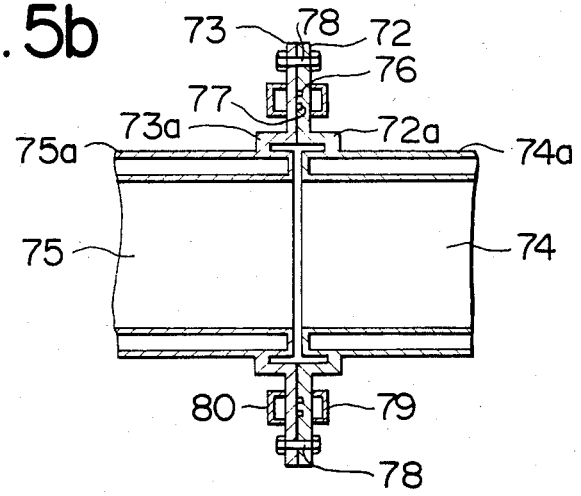
Figure 5C:
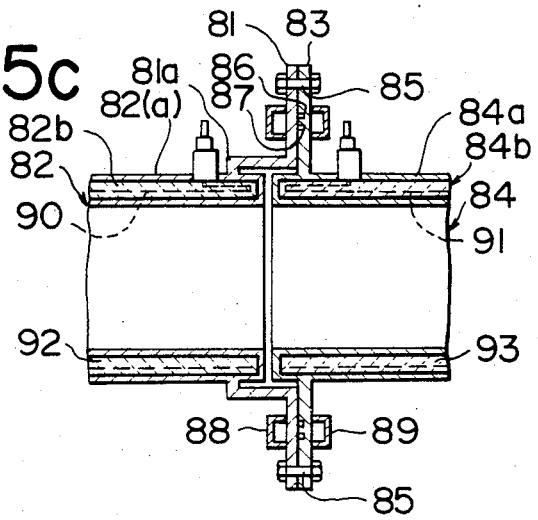
Figure 6:
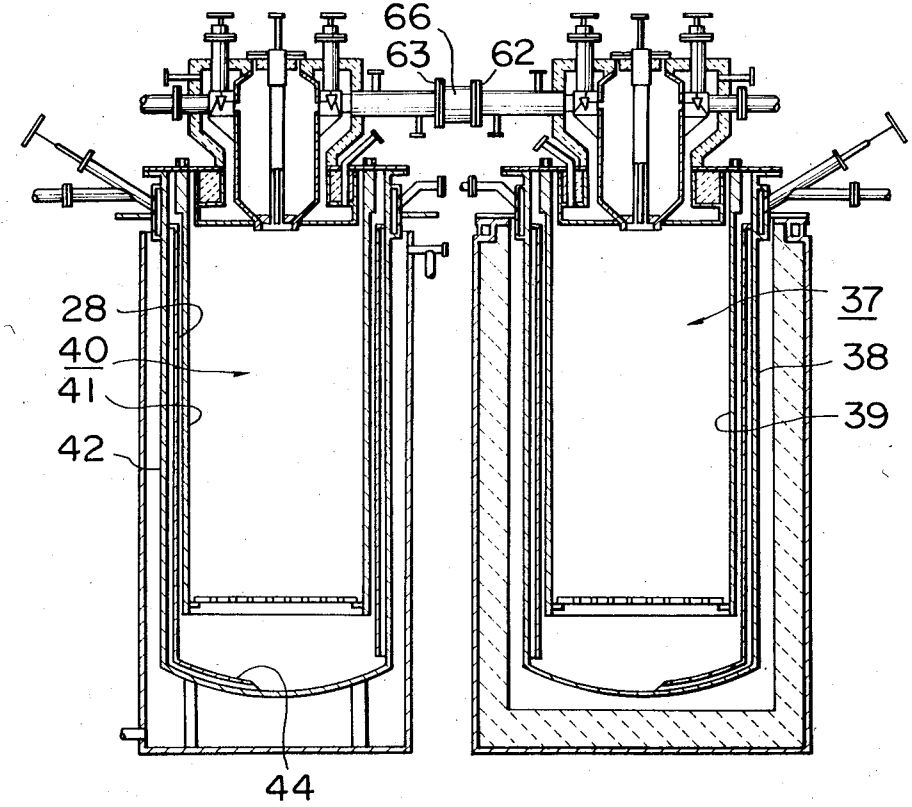

FIGS. 1–4 illustrate a few of variations in an elevational section of apparatuses constructed according to the invention, FIGS. 5*a*–5*c* illustrate a few of other variations also adaptable to joint between the duct and the top for a conversion/evaporation chamber, and FIG. 6 shows an installation of one of such joints.

Figure 2:
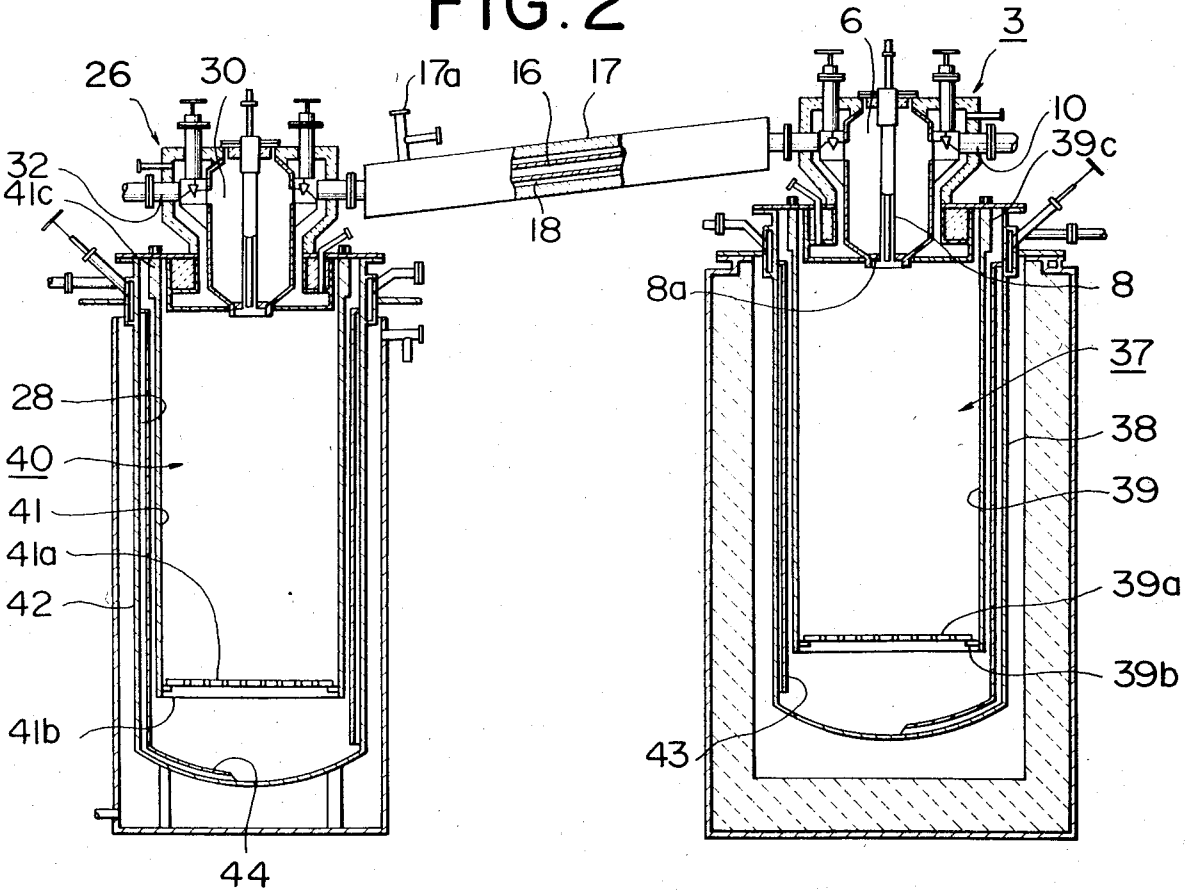

In the figures, and especially FIGS. 1 and 2 where tops of a substantially same construction are provided over both a conversion/evaporation chamber and a condensation chamber of either single or double-cylindrical configuration, a conversion/evaporation chamber, generally designated at 1 in FIG. 1, is substantially defined by a single cylindrical vessel 2 and a top 3, the former being supported in an electrical furnace 4 which has an iron shell 4*a* tightly laid thereon. An interspace 5 defined by the furnace 4 and the vessel 2 is closable airtightly and provided with a degassing means and, preferably, an inert gas supply in connection therewith, so that vessel wall may be subjected to a decreased pressure differential in an inert atmosphere. The top 3, in particular, comprises a cell 6, or a cylindrical room extending along the axis, and a pair of feeder tube 7 and sheath tube 8 with a circular closure flange 8*a* at the bottom, said tubes being in a coaxial and vertically movable arrangement inside the cell for, respectively, feeding starting material chloride and regulating a bottom opening of the cell 6. A pair of tubular members 9, 10 are open to be in connection with the cell on opposite positions with a valve 11, 12 on each for defining a path for effluent vapor and for degassing the chamber 1, respectively. The top 3 further comprises an annular metallic casing 13, stuffed with a mass of heat insulative 13*a*, and a gas jacket 14 which is defined by the casing 13 and a ceramic lined steel heat insulative casing 15. The jacket surrounds the cell 6, members 9, 10 and valves 11, 12 for temperature control in such way that solid condensates may not deposit therein, by passing a gas of elevated temperatures during a substantial part of conversion/evaporation process, and that remainder of vaporous magnesium metal and chloride may be solidified on cell walls and lower surfaces of the top, occasionally in preferred practices, by passing a gas of room temperatures or so at a conclusive stage of a purification process.

While the tubular member 10 is connectable at a flanged terminal with a degassing system (not shown), the other tubular member 9 is in connection with a vapor duct 16 on a flange provided on an outlet which extends outward from the casing 15. The duct 16 comprises an electrical furnace 17 so arranged as to extend therealong and to surround for a substantial part thereof in such way that an interspace 18 is hermetically closed and pressure regulatable through a tube 17*a* that a duct wall may be free from severe pressure differentials.

The vessel 2 comprises in a bottom, a plate 19, reinforced and spaced below by means of a shaft 20 which rises from a bottom panel of the vessel 2, so that metallic product may deposit to accumulate on the plate 19 and be somewhat separated from liquid phase which mainly comprises magnesium chloride by-product. The latter is dischargeable through a duct 21 which extends outward along a vessel wall with a valve 22 on the way. Not essentially but conveniently, another duct 23 can also be arranged along the vessel wall for introducing or replenishing fused magnesium into the vessel 2.

A condensation chamber generally designated at 24 is of a configuration common to the conversion/evaporation chamber and comprises a single cylindrical vessel 25 and a top 26 of substantially same geometries as ones for the conversion/evaporation chamber 1. The vessel 25 is so arranged as to rest on fins 27*a* in a tank 27 which allows water to flow for cooling and effecting condensation of magnesium metal and chloride in the vessel 25. In cases where said vessel comprises either or both of ducts 28, 29, just as the vessel 2 for the conversion-/evaporation chamber, they are closed with closure flanges and either or both are opened occasionally to be connected with a degassing system as desired. The top 26, in particular, comprises a cylindrical cell 30 which extends along the axis and in connection with tubular members 31, 32 with valves 33, 34 for defining a cavity to lead incoming vapor and for degassing, respectively. Flanged terminals extend outward through a gas jacket 35 and a ceramic lined steel casing 36. While one terminal 32*a* is provided for connection with a main degassing system, the other terminal 31*a* is in connection with the heatable vapor duct 16 so as to provide a continuous passage for vapor from the conversion/evaporation chamber 1 to the condensation chamber 24 during a purification process.

Another conversion/evaporation chamber, designated at 37 in FIG. 2, comprises a cylindrical vessel 38 and, in addition, another cylindrical member 39 as container for carrying metallic product on a detachable grate 39*a* which is detachably supported by stoppers 39*b*, while any bottom plate or shaft has been eliminated. A condensation chamber 40, similarly, of a double cylindrical configuration comprises a container 41 with a grate 41*a* on stoppers 41*b* coaxially arranged inside a cylindrical vessel 42.

Tops 3, 26 of substantially same constructions as described above are tightly arranged over the vessels 38, 42 and in a hanging joint by the containers 39, 41 by means of bolts run into a thickened wall portion thereof 39*c*, 41*c*. A passage is provided for vapor of impurities from the conversion/evaporation chamber 37 to condensation chamber 40 through cells 6, 30 and a vapor duct 16 extending therebetween and heatable with an electrical furnace 17 therearound, with an interspace 18 hermetically sealed for pressure regulation through tube 17*a*. Each vessel is also in connection with a degassing system (not shown) through the cell 6, 30 and tubular member 10, 32. The cell 6 over the conversion-/evaporation chamber 1 has a bottom opening regulatable with a closure flange 8*a* attached to a sheath tube 8 by vertical movement thereof.

FIGS. 3 and 4 illustrate specialized tops arranged over a conversion/evaporation chamber and a condensation chamber either a single or double cylindrical configuration. The apparatuses shown here comprise, for the purpose of simplified description, vessel means of substantially same constructions as in FIGS. 1 and 2, so corresponding members are to be found at same reference symbols, and understood from descriptions under them.

A top 45 over a single cylindrical conversion/evaporation chamber 1 comprises a vertical cell 46, a cavity 47 which consists a path for effluent vapor and, if desired, another cavity 48 for degassing the chamber 1 therethrough. The top 45 further comprises a gas jacket 49 in such arrangement as to surround a lower portion of the cell 46 as well as the duct up through a valve 50 to a vicinity of a flanged terminal 51 which extends through the jacket 49. A water jacket 52 is arranged around an upper portion of the cell 46. Along the axis through the cell 46 extend a pair of feeder tube 53 and sheath tube 54 in such coaxial and vertically movable arrangement that an opening with a sloped rim at a bottom of the cell is regulatable with a conical closure flange 54*a* by vertical adjustment thereof. The top, as a whole, is regulatable in temperature so that any solid may not deposit therein to cause plugging, by passing a gas of elevated temperatures for the most part of conversion and purification process, and that remainder of magnesium metal and/or chloride may deposit in solid on a cell walls and bottom surfaces of the top 45 by operating the water jacket 55 and, preferably passing a gas which conveniently consists of air, of room temperatures or so at a last stage of a purification stage.

Much simplified, a top 56 for a condensation chamber 24 comprises a disk plate 57, an annular metallic casing 58 filled with heat insulative stuffing 58*a* and run through in part by a cavity 59 with a downward flaring. A vapor duct 60 heatable with a gas jacket 60*a* (detailed later) is in a tight joint by welding with the top 56 at one end and with the terminal 51 by fastening at the other. A tube 61 extends through the top 56 into the condensation chamber for degassing thereof.

Tops of such constructions as described above can be provided likewise over a conversion/evaporation chamber and a condensation chamber, each, of double-cylindrical configurations as shown in FIG. 4, to which above given description is applicable relative to the vessel construction of FIG. 2 and top construction of FIG. 3.

In each of above described examples, the vapor duct connecting the tops over two chambers can be advantageously replaced by any one of such as shown in FIGS. 5*a*–5*c*. In FIG. 5*a*, wholly flat flanges 62 and 63 are in an immediate joint by welding at recessed positions backward from opposed extremities of the outer walls 64*a*, 65*a* of jacketed substrates, which are either vapor duct or outlet of a vapor path. A spool-shaped connector 66 which has an inner diameter of somewhat greater than the outer diameter of members 64, 65 to be connected and a length such as to give a spacing therebetween large enough, but not in excess anyway, to allow a substantially free expansion of the members as heated, is arranged between the flanges 62, 63 with a pair of heat resistant rubber packings 67, 68 inserted and fastened with bolts 69. The packings 67, 68 are coolable with annular water jackets 70, 71 provided on opposite sides of the flanges. The jacket 64*b*, 65*b* comprises an end wall thinner than the flanges 62, 63 and, in this illustrated example, is designed to pass a heated gas therethrough. This variation, as applied to connection of the vapor duct and cavity terminal in the invention is shown as an example in FIG. 6.

Such connector can be eliminated in some cases where joint of rather a decreased mechanical strength is sufficient. Annular flanges 72, 73 with a boss or a cylindrical sleeve 72*a*, 73*a* are in a weld joint to the outer wall 74*a*, 75*a* of each jacketed members 74, 75 in FIG. 5*b*. The flanges are secured by the bosses which are joined at such recessed positions backward from opposed extremities of members 74, 75 that the flanges 72, 73 are in contact with each other with heat resistant rubber packings 76, 77 inserted therebetween and fastened by bolts 78, and that a spacing is provided between the bosses 72*a*, 73*a* and outer walls 74*a*, 75*a* of jacketed members 74, 75 and between the opposed ends, such spacing large enough but not in excess anyway to allow substantially free expansion of the members as heated. The packings 76, 77 are coolable with annular water jackets 79, 80 arranged on the flanges 72, 73.

Still another variation of duct-cavity terminal joint is seen in FIG. 5*c*, where an annular flange 81, welded in a central cylindrical boss 81*a* at a recessed position backward from an end of a member 82, is in contact with a wholly flat flange 83, which is in an immediate joint by welding to an outer wall 84*a* of jacketed member 84, and fastened with bolts 85 on flat faces. Two heat resistant packing rings 86, 87 are arranged between the flanges 81, 83 and coolable with annular water jackets 88, 89 on both flanges thus fastened. The jackets 82*b*, 84*b* of this illustrated example contain an electroresistive spiral element 90, 91 embedded in a layer of electrical insulative mass 92, 93. Thus constructed joints permit connection on flange of an O.D. of 445 mm, for example, on 216 mm I.D. ducts, in comparison with a 560 mm O.D. for conventionally designed joints without jacketed ducts of the same I.D..

Apparatuses of above given designs, for example, are operated as follows:

The feeder tube 7, 53 and sheath tube 8, 54 are set in their lower positions to close a cell 6, 46 over a conversion/evaporation chamber, while the valve 11, 50 are operated so as to close a passage to the condensation chamber in connection. On introduction of a given amount of fused magnesium to the conversion/evaporation chamber 1, 37 through the duct 23, 43, starting material chloride such as titanium tetrachloride is supplied through the feeder tube 7, 53 to cause a reaction thereof with magnesium. Thus formed, metallic product, such as titanium, deposits to accumulate on the plate 19 or grate 39*a*, alternatively, while magnesium chloride by-product accumulates in a bottom of the vessel 2, 38 and discharged therefrom continuously or intermittently through the duct 21, 39.

On termination of a conversion stage, the tubes 7 and 8, 53 and 54 are lifted to open the cell 6, 46, while the valve 11, and 50 are operated to open the passage to the condensation chamber and to a vacuum pump. The both chambers are degassed through the member 32, 61, as well as the duct 28, 44 extending along a wall of condensation vessel. The furnace is powered to heat a mixed deposit to some 1000° C. in the vessel 2, 38 so that magnesium metal and chloride therein may be evaporated, transferred through the vapor duct 16, 60 to the condensation chamber, where or by when they are condensed to liquid and then solidified on a vertical wall or a bottom wall of condensation chamber. During such condensation stage, gas burners are set so that a gas of elevated temperatures therefrom may pass the gas jacket and heat the cell to a temperature over 750° C. for prevention of deposit of solid condensates such as magnesium metal and chloride. Although the evaporation and condensation can be continued in corresponding chambers until the treatable mass in the conversion-/evaporation chamber exhibits a substantially limited impurity content in magnesium metal and chloride, it is preferable for an improved process efficiency that the cell be cooled by passing a gas of lower temperatures through the gas jacket on the top so that vaporous impurity remainder in the conversion/evaporation chamber may be solidified to adhere, at least partly, on a cell wall and a bottom surface of the top 3, 45. Such condensates are conveniently recovered by arranging and heating the top over a condensation chamber before another purification process is operated. Purified refractory metal is obtained and recovered from the bottom plate or grate in the conversion/evaporation chamber, after the latter has been disassembled. In joint with the top, the vessel means, single or double cylindrical, with condensates of magnesium metal and chloride thereon is placed in the furnace for another conversion process.

EXAMPLE 1

An apparatus of a construction basically shown in FIG. 1 was operated for production of titanium metal from titanium tetrachloride by reduction with magnesium. A cylindrical vessel of SUS 410 (designation according to JIS) stainless steel which measured 1.7 m in I.D., 4.5 m in length and 32 mm in wall thickness, was set in each of electrical furnace of a 2.5 m O.D. and a 5 m length with an iron shell thereon, and a tank of stainless steel, which allowed water overflow, to consist a conversion/evaporation chamber and a condensation chamber, respectively. The interspace between the vessel and furnace was airtightly closed and connected with a degassing pump and an inert gas supply. A top comprised a cylindrical cell of a 1 m I.D. and a 1.5 m length, defined by a stainless steel partition, and a gas jacket defined by a ceramic lined steel casing was arranged tightly over each of the chambers. The tops were connected with each other by means of a duct of a 3 m length and a 15 cm I.D. with a hermetically closed electrical furnace therearound.

The conversion/evaporation chamber was set in argon atmosphere, supplied with some 9 tons of fused magnesium, heated to some 800° C., and then supplied with liquid titanium tetrachloride at a rate of 400 Kg/h to cause a conversion thereof. While magnesium chloride by-product was intermittently discharged from the bottom, supply of said tetrachloride was continued until a total introduction of 25 tons of the chloride was reached, then liquid phase comprising magnesium chloride was, for the most part, discharged from the bottom under the solid deposit.

After being substantially degassed, the condensation chamber was communicated with the conversion-/evaporation chamber by opening the valves on each side of the vapor duct. A temperature of some 800° C. was maintained throughout the cell, cavity and duct by operating the gas jacket and furnaces. The conversion-/evaporation chamber was heated to some 950°-1000° C., while water was filled and overflowed from the tank for the condensation chamber, and the interspaces around the duct and of the conversion/evaporation chamber were degassed. Purification process was continued for some 70 hours by evaporating magnesium metal and chloride in the conversion/evaporation chamber and solidifying the same on walls of the condensation chamber. When decrease in transfer rate of vapor was observed as indicated by remarkable slowing temperature rise of the duct, colder gas was substituted and passed in the gas jacket of the conversion/evaporation top so as to provide a condensation face which permitted solidification and adhesion thereto of magnesium metal and chloride which remained vaporous then in the chamber. The process resulted in recovery of some 6.2 tons of titanium from the vessel. The latter, as evacuated, was joined to the top with solid condensate adhesion thereon, had such adhesion removed by melting, and then was used for condensation of incoming impurities during another purification process.

EXAMPLE 2

An apparatus of a construction of FIG. 2 was used for production of titanium metal from titanium tetrachloride. A conversion/evaporation chamber consisted of a cylindrical vessel of SUS 316 stainless steel, which measured 1.7 m in I.D., 4.5 m in length and 32 mm in wall thickness, and a cylindrical container of SUS 430 stainless steel which measured 1.6 m in I.D., 3.7 m in length and 19 mm in wall thickness, each being fastened by bolts with a top of the design of Example 1 plus minor dimensional changes. The pair was arranged in an electrical furnace similarly to Example 1.

Another pair of such vessel and container were arranged in a stainless steel tank to set up a condensation chamber and connected with the first pair by means of the vapor duct of a design of Example 1.

The conversion/evaporation chamber was set in argon atmosphere, supplied with some 7 tons of fused magnesium, heated to some 800° C. as on the container, and supplied with liquid titanium tetrachloride at 400 Kg/h to a total of 20 tons of $TiCl_4$ over a period of about 50 hours, while magnesium by-product was discharged intermittently. On termination of chloride supply, liquid phase comprising magnesium chloride, accumulated under the grate, was entirely discharged. Bolts were loosened so that a small gap was provided between opposed ends of the top and container. The conversion/evaporation chamber was degassed. The gas jacket and furnaces were operated to heat the duct and top to some 800° C., and then valves were opened to communicate said chamber with the condensation chamber which was set in an overflowing water. The conversion/evaporation chamber was heated to some 950°-1000° C., as to evaporate magnesium metal and chloride and to leave metallic product. The interspace around the duct and conversion/evaporation chamber were degassed.

Purification process was thus continued for a period of some 80 hours since the chamber communication until a vacuum of $10^{-3}$ Torr was reached. After cooling to an accessible temperature, the conversion/evaporation chamber was disassembled by unbolting the top and then the container, from which some 5 tons of titanium was recovered. The vessel and container in the condensation chamber, which held condensates of magnesium metal and chloride, were transferred into an electrical furnace for use as conversion/evaporation chamber in another conversion process. The container, as unloaded of titanium metal, was joined to the top and set in a tank for condensation chamber.

EXAMPLE 3

The conversion-purification cycle of Example 1 was repeated for the most part with an apparatus of a FIG. 3 construction. In this example, the conversion/evaporation chamber comprised a single cylindrical vessel of SUS 410 stainless steel which measured 1.8 m in I.D., 5.6 m in length and 32 mm in wall thickness, and arranged in an electrical furnace with an iron shell, which measured 2.8 m in O.D. and 6.2 m in length. The interspace was hermetically closed and provided with a degassing means. A top of a generally cylindrical outer configuration comprised a cell of a 1.3 m maximal I.D. and a 2.6 m length, a water jacket on an upper area, and a gas jacket on a lower area of the cell wall. Another vessel of such dimensions was arranged in a tank for condensation chamber and joined upward to a top which carried a metallic casing for a mass of heat insulative of pearlite. The both vessels were connected by means of a vapor duct heatable with a gas jacket provided thereon. The duct was fastened at one end with a flanged terminal of vapor path outlet of the conversion-/evaporation top and, at the other, welded to the condensation top so as to provide a smooth path continuous with a conical cavity in the latter top.

9 tons of fused magnesium was first introduced to the conversion/evaporation chamber maintained at some 800° C. in argon atmosphere. Then titanium tetrachloride was supplied at a rate of 400 Kg/h to a total of 25 tons of $TiCl_4$ over 60 plus hours. Liquid accumulation at the bottom was discharged periodically during and after the conversion stages. The vapor path outlet and duct were heated to some 800° C. by operating the gas jackets of respective members so that emission gas was supplied therein from gas burners. Purification stage took about 70 hours of heating of the mass in the vessel. At the end of heating when decrease in temperature rise was observed, valves were operated to close the vapor path while the cell was opened by lifting the closure flange and cooled by operating the water jacket and by blowing air of lower temperatures into the gas jacket in the place of hotter one, so that remainder of vaporous magnesium metal and chloride was solidified on the cell wall for the most part. The above cycle finally produced 6.2 tons of titanium which was recovered from the vessel. The vessels of both chambers as well as the tops were likewise treated as in Example 1.

Such vessels remained effective for repeated conversion/purification cycles of over 50 times.

EXAMPLE 4

An apparatus substantially shown in FIG. 4 was used for production of purified titanium. In a hanging joint to a top of a substantially same design as in Example 3, with minor dimensional changes and additional provision for bolt fastening of a container, were a pair of cylindrical vessel of SUS 316 stainless steel and cylindrical container of SUS 430 stainless steel, the former measuring 1.7 m in I.D., 4.5 m in length and 32 mm in wall thickness, while the latter, 1.6 m in I.D., 3.7 m in length and 19 mm in wall thickness, with the latter coaxially arranged inside the former. The vessel was likewise set in an electrical furnace of Example 2.

The condensation chamber similarly comprised another vessel and container, fastened by bolts in a hanging joint to a top of a substantially same design as the corresponding member in Example. A duct heatable with a hot gas in a jacket was welded at one end to the top of condensation chamber and, at the other, fastened to the flanged terminal of vapor path outlet.

On introduction of 7 tons of fused magnesium to the conversion/evaporation chamber in argon atmosphere, likewise to Example 2, a conversion process was operated by feeding titanium tetrachloride at 400 Kg/h to a total of 20 tons of $TiCl_4$ over some 50 hours.

Liquid accumulation at the bottom was intermittently discharged during and after the conversion stage. A small gap was provided between opposed ends of the top and container. The conversion/evaporation chamber was degassed, the conversion/evaporation top and duct were heated to some 800° C., and then the both chambers were communicated by opening the valve on the vapor passage. The conversion/evaporation chamber was heated to some 950° C.–1000° C., while the condensation chamber was water-cooled. Decrease in transfer rate was observed some 80 hours after evaporation heating strated. The conversion/evaporation top was cooled to solidify to let condensates adhere to the cell wall likewise to the antecedent example.

On cooling, the conversion/evaporation chamber was disassembled by unbolting the top, lifting the container from the vessel and unbolting the same to open. Some 5 tons of titanium metal was recovered in spongy state. The containers and tops were treated for another cycle similarly to Example 2.

The vessels of this example were effective for repeated such cycles over 50 times.

The cycle of this Example took an overall period of some 10 days, including assembling and disassembling of chambers, in comparison with an average of about 15 days for production of such quantity of purified titanium metal with separate apparatuses for each stage of process.

EXAMPLE 5

The vessels, containers and tops as well as the furnace and water tank of Example 2 were used for both of conversion/evaporation chamber and condensation chamber. The both tops comprised jacketed tubular members of a 24 cm I.D., with one on the conversion/evaporation top as vapor path, while one on the condensation top consisted a duct of an integral arrangement with the cavity within the top. Said tubular members as a whole exhibited a length (from one ceramic lined steel casing to the other) of some 70 cm, and comprised flanges of an O.D. of 72 cm on recessed positions from opposed ends at an interflange space of 10 cm. The members were connected by means of a spool-shaped connector sleeve with a similarly wide flange at each end, with heat insulative rubber rings inserted therebetween and cooled with water jacket.

This apparatus was successfully operated at parameters and handling described in Example 2, except that the duct was heated with a hot gas in the place of electrical furnace.

As may have been understood from the description given above in detail, the present invention permits such advantages over conventional techniques that:

(1) as a result of fundamentally eliminated transfer of a mixed deposited mass from a conversion stage to a purification stage in sequence of cycle, a substantial saving is achievable in labor, power and/or time involved in cooling and re-heating of the vessels and assembling and disassembling of the apparatuses, which would be otherwise necessary, (2) evolution into environments of such noxious gas as $TiCl_4$ which inevitably remains to a degree in the deposited mass, can be completely avoidable, (3) heavy duty hoists are unnecessary any more, which have been a requisite for arranging a member carrying the treatable mass in a vertical alignment with another member for depositing condensates thereon, and for transfer of such joined members so as to place in or taking out of a furnace; an improved room occupation efficiency can also be achieved for a plant housing relative to production capacity, as a result of eliminated transfer of such vertical elongated structure;

(4) an improved purification rate is achievable as a result of fundamentally overcome troubles that have been seen to be caused by once deposited impurities dropping from a condensation zone into an evaporation zone thereunder in vertical alignment;

(5) unfavorable lower chlorides such as $TiCl_2$ and $TiCl_3$, which otherwise would form at a later stage of conversion process are not allowed to form, so lowered yields or burning of metallic product caused thereby have been substantially overcome; and (6) improved accessibility is available to the apparatus by adopting smaller flanges on jacketed members for connection of both chambers.

We claim:

1. An apparatus for producing purified refractory metal from a chloride thereof, comprising: a conversion/evaporation chamber defined by a first substantially cylindrical vessel means and a detachable top member arranged thereover, said top member in turn comprising therewithin an axial cell closed at the top and having an opening at the bottom, a cavity which is in an abutting relation with the cell and communicable with the vessel means so as to provide a path for vapor stream of magnesium and chloride thereof arising from the vessel means, said cavity at one end consisting of a flanged tubular outlet, a gas jacket which surrounds the cavity and the cell at least a lower portion thereof and which has an access to each gas source of elevated temperatures and room temperatures, a condensation surface substantially defined by the gas jacket and exposable to the vapor stream, a valve arranged in the cavity for regulation of the vapor stream through the outlet, a vertically movable chloride feeder tube with a closure flange secured therearound and movable together so as to close the opening of the cell, a furnace means which surrounds the vessel means, a condensation chamber which is in side-by-side relation with the conversion/evaporation chamber and defined by a second substantially cylindrical vessel means and a second top member arranged detachably thereover, said top member having a cavity which is connected by a heatable duct to the outlet of the first said cavity and is open to the second said vessel means so as to form a continuous passage for the vapor stream, and a cooling means for such vessel means by passing water therearound, each of said vessel means consisting of a cylindrical member of a substantially common geometry and being fastened to respective top members with a fastening means compatible to each other.

2. The apparatus as recited in claim 1, in which said duct is surrounded over a substantial length thereof by an electrical furnace to provide between the furnace and duct an airtightly closed interspace to which a pressure controlling means is connected.

3. The apparatus as recited in claim 1, in which said duct has a jacket on the wall and a heating means contained therein.

4. The apparatus as recited in claim 3, in which said heating means comprises a gas emitted from a gas burner at work.

5. The apparatus as recited in claim 3, in which said heating means comprises an electroresistive element.

6. The apparatus as recited in claim 1, in which said duct comprises a flange with an axial boss which is in the end secured to the duct at a recessed position and extends therefrom coaxially with the duct to outreach the extremity of the duct.

7. The apparatus as recited in claim 3, in which said duct and the cavity outlet of the first top member, each, have a generally flat flange secured to respective substrata at a recessed position backward from the extremity of the duct, and are in connection with each other by means of a spool-shaped sleeve inserted therebetween and fastened with bolts.

8. The apparatus as recited in claim 1, in which said duct and cavity outlet of the first top member are in an airtight connection with the flanged tubular outlet giving a gap for thermal expansion allowance between the opposite extremities of the respective substrata.

9. The apparatus as recited in claim 1, in which said duct has a downward inclination towards the condensation chamber.

10. The apparatus as recited in claim 1, in which said cavity of the first top member is defined by one of two tubular members which extend in common horizontally and are open to the cell, said tubular members substantially being contained in the gas jacket.

11. The apparatus as recited in claim 10, in which said top member is of a substantially common construction with the second top member.

12. The apparatus as recited in claim 1, in which said cavity of the first top member extends substantially vertically along the cell and is open at the bottom to the vessel member.

13. The apparatus as recited in claim 12, in which said top member comprises a water jacket surrounding a portion thereof located above the gas jacket.

* * * * *